US005537948A

United States Patent [19]

Kobayashi

[11] Patent Number: 5,537,948

[45] Date of Patent: Jul. 23, 1996

[54] WATER VEHICLE WITH HAND GRIP

[75] Inventor: Noboru Kobayashi, Iwata, Japan

[73] Assignee: Yamaha Hatsudoki Kabushiki Kaisha, Iwata, Japan

[21] Appl. No.: 411,580

[22] Filed: Mar. 29, 1995

[30] Foreign Application Priority Data

Mar. 29, 1994 [JP] Japan ..... 6-058848

[51] Int. Cl.[6] ..... B63B 35/00

[52] U.S. Cl. ..... 114/270; 114/362; 440/88

[58] Field of Search ..... 114/270, 362, 114/363; 440/88, 89

[56] References Cited

U.S. PATENT DOCUMENTS

| | | | |
|---|---|---|---|
| 2,808,892 | 10/1957 | Walker . | |
| 3,948,206 | 9/1974 | Tyler | 114/270 |
| 3,981,321 | 9/1976 | Risse et al. | 137/255 |
| 4,787,344 | 11/1988 | Okumura et al. | 123/65 PE |
| 4,824,409 | 4/1989 | Kobayashi | 114/270 |
| 4,930,476 | 6/1990 | Oguri et al. | 123/376 |
| 4,951,465 | 8/1990 | Torigai | 440/89 |
| 4,984,528 | 1/1991 | Kobayashi | 114/270 |
| 5,123,372 | 6/1992 | Kobayashi et al. | 114/362 |
| 5,234,364 | 8/1993 | Ito | 440/89 |

FOREIGN PATENT DOCUMENTS

| | | | |
|---|---|---|---|
| 4266589 | 9/1992 | Japan | 114/270 |

*Primary Examiner*—Jesus D. Sotelo
*Attorney, Agent, or Firm*—Knobbe, Martens, Olson & Bear

[57] ABSTRACT

Two embodiments of small watercraft having a straddle-type rider's seat with a seat back and a deck to the rear of the seat back. A handle is provided on the seat back for grasping by a rider standing on the rear deck. In addition, a pivotally supported boarding ladder assists in entry of the watercraft from the body of water in which it is operating. The handle assists in this boarding operation. There is also provided a ventilating system for the engine compartment and a storage compartment for containing an auxiliary fuel tank which may transfer fuel to a main fuel tank positioned in the engine compartment.

22 Claims, 6 Drawing Sheets

WATER VEHICLE WITH HAND GRIP

BACKGROUND OF THE INVENTION

This invention relates to a water vehicle and more particularly to an improved water vehicle having a hand grip for affording increased rider capacity, an improved ventilating system for such a watercraft, and an improved fuel system therefor.

There is a very popular type of small watercraft commonly referred to as a "personal watercraft". This watercraft derives this name from the fact that it is designed primarily to be operated and ridden by a single person. Because of the extremely compact nature of these watercraft, it is common to provide them with a straddle-type seat on which the rider sits in a straddle fashion. Occasionally, the seats may be long enough to accommodate several riders seated in tandem, straddle fashion. However, by extending the seat, the overall size of the watercraft becomes larger than may be desired in many applications.

It is, therefore, a principal object of this invention to provide an improved small watercraft of this type which accommodates an operator/rider and also a passenger standing behind the operator/rider.

When this type of arrangement is provided, it is desirable to ensure that the standing passenger has a way of steadying himself. Furthermore, this type of watercraft generally has an open transom so that the rider and passengers can enter the watercraft from the body of water in which the watercraft is operating and from the rear.

Therefore, it is a still further object of this invention to provide an improved seat and handle arrangement that will facilitate a rider's entering the watercraft from the rear and also for steadying a rider standing on the rear deck of the watercraft.

As has been noted, this type of watercraft is frequently boarded from the rear through the open transom. However, if the rider's seat extends to the rear of the watercraft or nearly to the rear thereof, then the rider does not have sufficient room to easily enter the watercraft from the body of water in which the watercraft is operating.

It is, therefore, a still further object of this invention to provide a watercraft of this type that includes a rearwardly positioned boarding ladder than can cooperate with the handle to assist riders in entering the watercraft from the body of water in which the watercraft is operating.

Personal watercraft of the type described normally have an engine compartment that is positioned either beneath the seat or beneath a forward deck to the front of the seat. As is well know, it is desirable and, in fact, necessary to provide not only air to the engine compartment for engine combustion, but also ventilating air for the engine compartment. With this type of arrangement, it is also desirable that the ventilating system be effective in providing copious amounts of air without introducing water from the surrounding area into the engine compartment.

It is, therefore, a still further object of this invention to provide an improved ventilating system for a small watercraft.

It is a still further object of this invention to provide a compact and effective ventilating system for a small watercraft that will permit large amounts of air to pass through the engine compartment for ventilation and, at the same time, ensure that any water that may be drawn into the ventilating system cannot pass through to the engine compartment.

It should be apparent from the foregoing description that the nature of this watercraft provides a very compact assembly. Because of this compact nature, the fuel capacity of the watercraft tends to be relatively small. This means that the watercraft cannot be conveniently used for long trips or cruising, and this is, at times, a disadvantage.

It is, therefore, a still further object of this invention to provide an improved and auxiliary fuel supply system for a watercraft of this type.

SUMMARY OF THE INVENTION

A first feature of the invention is adapted to be embodied in a small watercraft that is comprised of a hull and which has a passengers' area formed at the rear of the hull. A straddle-type seat is formed in the passengers' area and is adapted to accommodate at least one rider seated thereon in straddle fashion. A seat back is formed at the rear of the straddle-type seat on which the rider may place his back. Means form a handle at the top of the seat back.

Another feature of the invention is adapted to be embodied in a small watercraft comprised of a hull defining an engine compartment, a forward deck and a passengers' area to the rear of the forward deck. A ventilating compartment is formed beneath a forward part of the forward deck and an air inlet is formed in the forward deck for communicating atmospheric air with the ventilating compartment. A breather tube extends from an upper area of the ventilating compartment that is spaced from the air inlet into the engine compartment for delivering ventilating air thereto.

Yet another feature of the invention is adapted to be embodied in a small watercraft that is comprised of a hull that defines an engine compartment, a forward deck and a passengers' area to the rear of the deck. An engine and main fuel tank therefor is contained within the engine compartment. The forward deck forms a further compartment that is spaced from the engine compartment and which is adapted to accommodate a reserve fuel tank. Means are provided for transferring fuel from this reserve fuel tank into the main fuel tank in the engine compartment.

DETAILED DESCRIPTION OF THE PREFERRED EMBODIMENTS OF THE INVENTION

Figure 1:
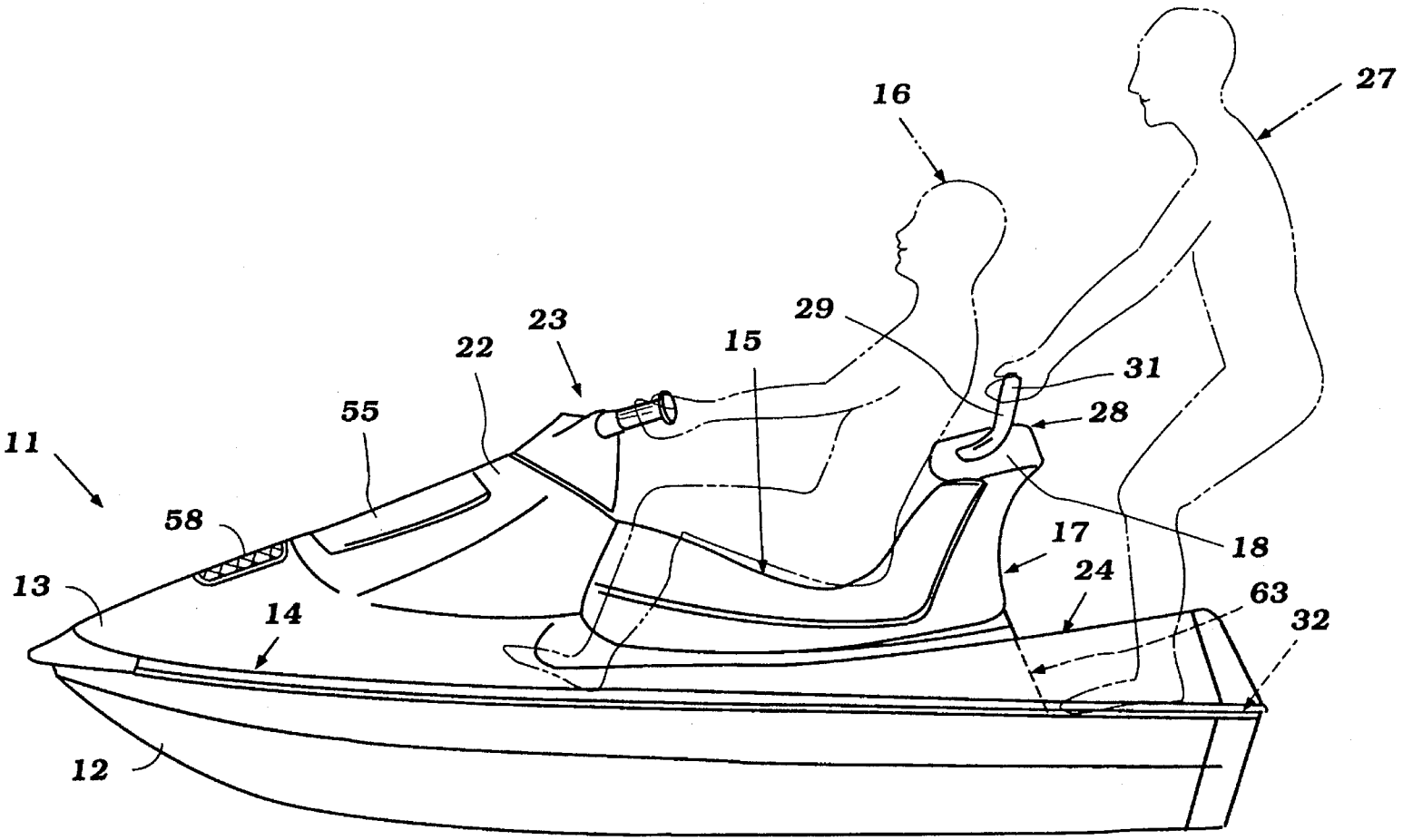
FIG. 1 is a side elevational view of a small watercraft constructed in accordance with the first embodiment of the invention and shows the rider/operator and a single passenger in phantom to illustrate how they are accommodated.

Referring now in detail to the drawings and initially to the embodiment of FIGS. 1–4, a small watercraft constructed in accordance with this embodiment is identified generally by the reference numeral 11. The watercraft 11 is comprised of a hull made up of a lower hull portion 12 and an upper deck portion 13. The hull portions 12 and 13 are formed from a suitable material, such as a molded fiberglass reinforced resin, or the like. These portions 12 and 13 are connected to each other around their periphery by means of a gunnel 14. A rider's area is formed to the rear of the forward portion of the deck 12 and includes a centrally positioned rider's seat 15 that is sized and configured so as to accommodate a single rider/operator, as shown in phantom and at 16 in FIG. 1. The seat 15 is provided with a seat back 17 against which the operator/rider may place his back, as shown in FIG. 1. This seat back 17 terminates at its upper end in a bolster 18.

The rider's area forms a pair of foot areas 19 on opposite sides of the seat 15 in which the rider/operator 16 may place his feet. Forwardly of the foot areas 19, there are provided upwardly and forwardly inclined portions 21 which provide foot rests, as shown in FIG. 1.

The portion of the deck 13 to the front of the seat 15 is provided with a raised area 22. A control mast 23 is mounted at the upper part of this raised area 22 and is operably connected to the propulsion device, in a manner which will be described, for steering of the watercraft 11. In addition, other watercraft controls, such as a throttle control, may be carried by the mast 23.

The sides of the foot areas 19 are bounded by raised gunnel portions 24. A rear deck 25 extends to the rear of and is integrally formed with further foot areas 26 that are disposed behind the foot areas 19 so as to accommodate a standing rider, as shown at 27 in FIG. 1.

In order to permit stability for the rider and for boarding purposes, as will be described, a handle assembly, indicated generally by the reference numeral 28, is provided at the top of the seat back bolster 18. This handle assembly 28 is comprised of a pair of side portions 29 which are connected in suitable manners to the bolster 18 and a transversely extending portion 31 that interconnects the side portions 29. This transversely extending portion 31 is grasped by the rider when standing on the rear deck 25. As may also be apparent, the passenger or rider may also move forwardly from the rear deck 25 along the side foot areas 26 to the foot areas 19 so as to mount on the seat 15. The side portions 29 of the handle assembly 28 assist in maintaining stability during this maneuvering.

Figure 2:
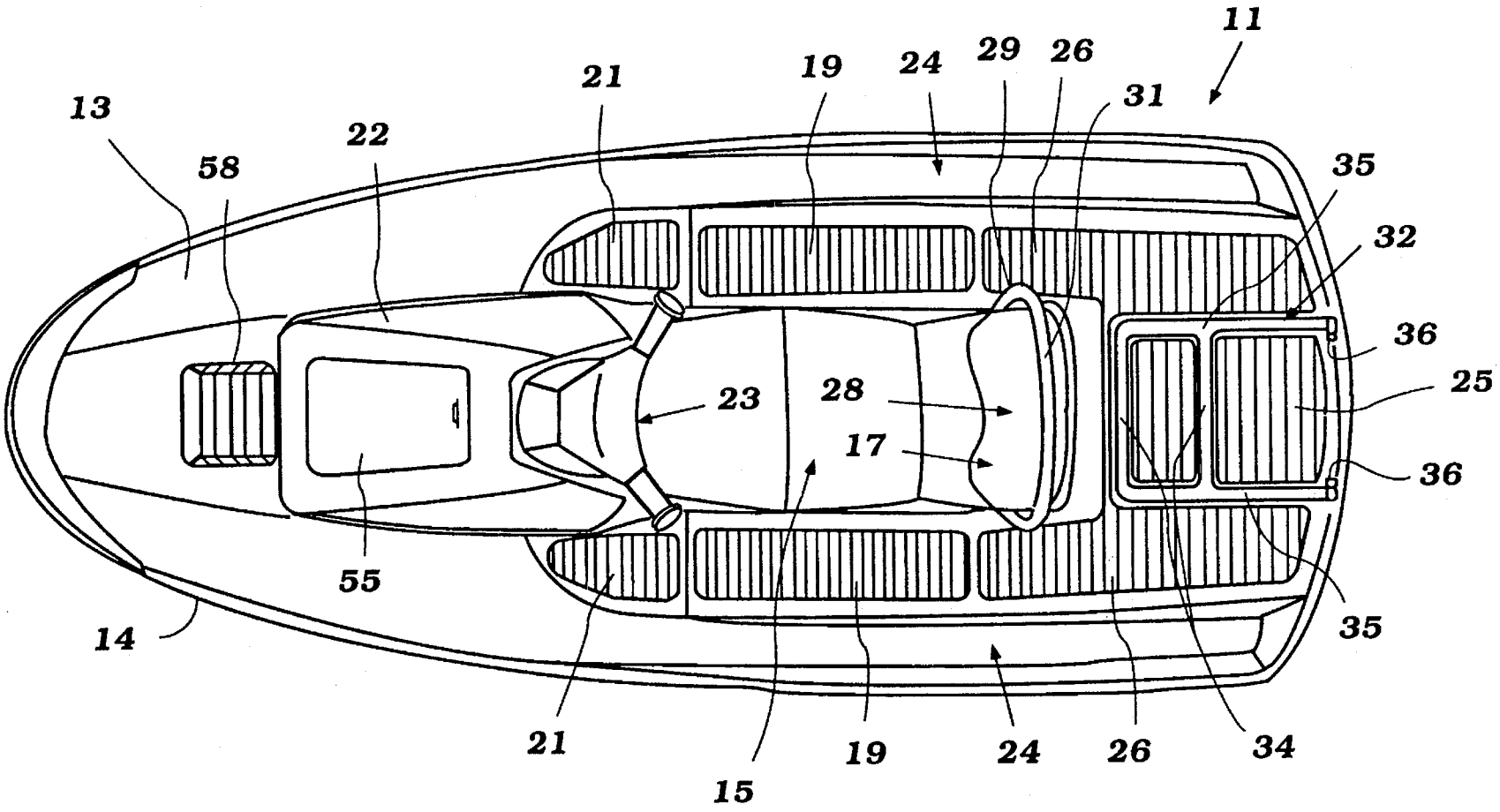
FIG. 2 is a top plan view of the watercraft with the passengers not present.
Figure 3:
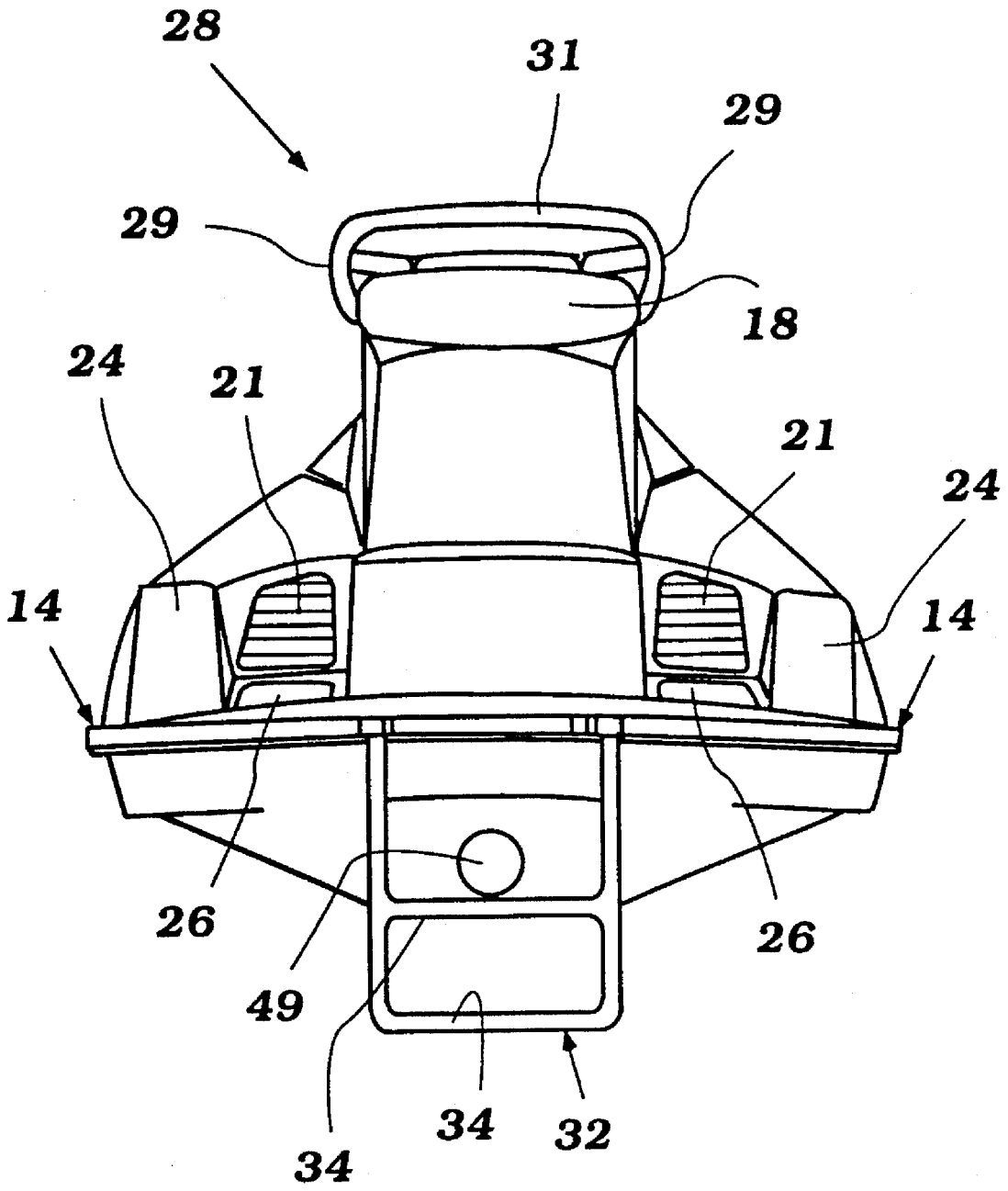
FIG. 3 is a rear elevational view showing the boarding ladder folded down into a boarding position.

It should be noted that the rear of the deck portion 25 opens through the transom of the watercraft 11 so that riders may enter the riders' area from the body of water in which the watercraft is operating. To assist in this operation, a boarding ladder, indicated generally by the reference numeral 32, is provided. The boarding ladder 32 has a pair of rungs 34 connected by side legs 35. The side legs 35 terminate in ends 36 that have a pivotal connection to the rear part of the deck portion 13 for movement between a storage area in a recessed portion of the rear deck 25, as shown in FIGS. 1 and 2, and a lowered boarding position, as shown in FIG. 3. When in this lowered position and the passengers stand on the rungs 34, the handle assembly 28 is disposed so that it can be conveniently grasped so as to assist in boarding. When the vessel is in motion, the boarding ladder 32 may be easily folded to the storage position, as shown in FIGS. 1 and 2.

Figure 4:
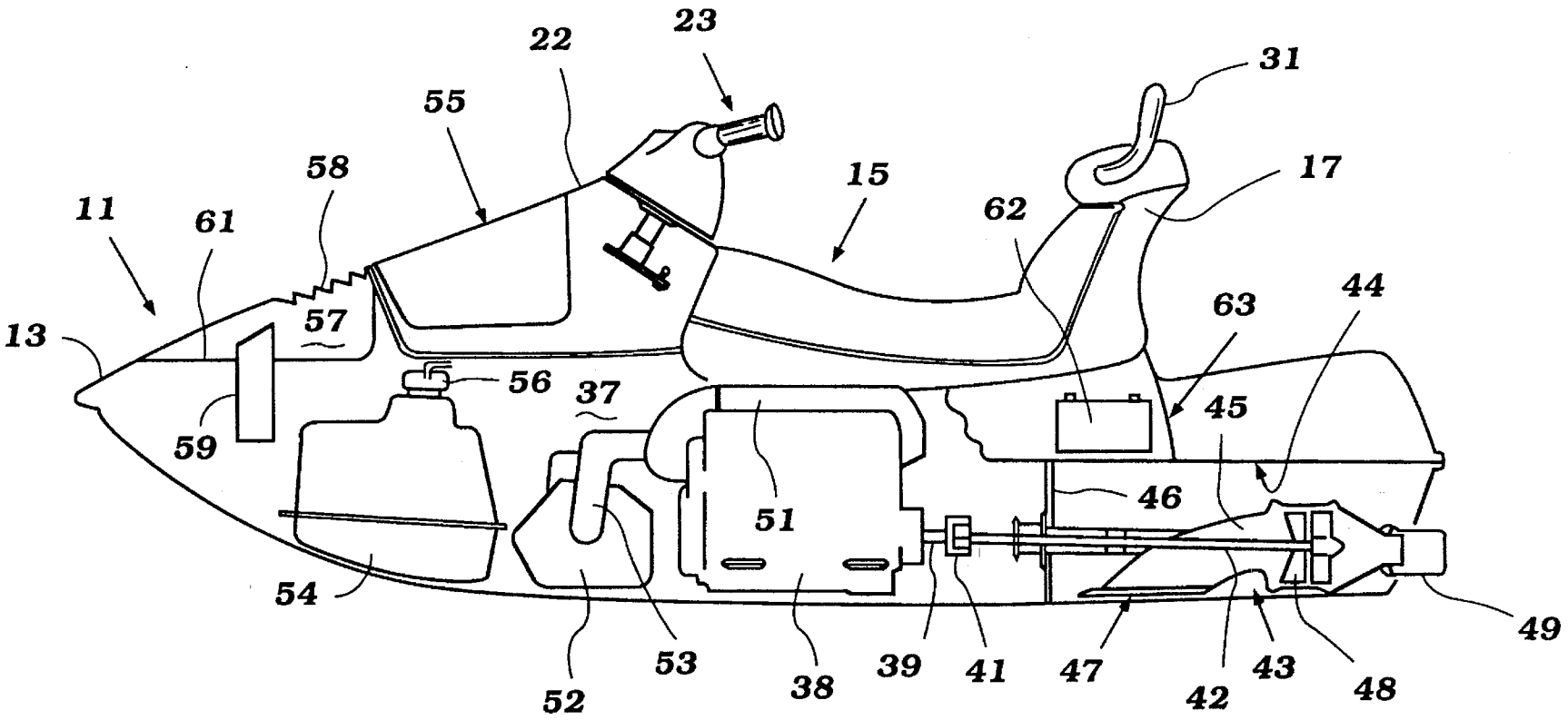
FIG. 4 is a cross-sectional view taken along a plane parallel to the plane of FIG. 1 to show certain of the internal components.

Referring now to FIG. 4, the propulsion system for the watercraft 11 is illustrated and will be described. The hull and deck portions 12 and 13 define an engine compartment 37 which is disposed in part beneath the seat 15. An internal combustion engine 38 of any known type is mounted in this engine compartment, and in the illustrated embodiment is disposed beneath the seat 15. This positioning of the engine 38 permits it to be mounted mid-ship and thus can retain the longitudinal center of gravity substantially at mid-ship.

The engine 38 drives an output shaft 39 which is coupled by a coupling 41 to the impeller shaft 42 of a jet propulsion unit, indicated generally by the reference numeral 43. The jet propulsion unit 43 is mounted in a tunnel, indicated generally by the reference numeral 44, which is formed in the underside of the hull portion 12 beneath the rear part of the seat 15 and the rear deck 25. This jet propulsion unit 43 includes an outer housing 45 through which the impeller shaft 42 extends. It should be noted that the impeller shaft 42 passes through a bulkhead 46 formed at the forward portion of the tunnel 44. The outer housing 45 defines a downwardly facing water inlet 47 through which water is drawn by an impeller 48 that is affixed to the impeller shaft 42 and within the housing 45. This water is then discharged rearwardly through a discharge nozzle 49 which may be pivotal about a vertically extending axis for steering by the mast 23 in a known manner.

The engine 38 is provided with an exhaust system that includes an exhaust manifold 51 that delivers exhaust gases to a forwardly positioned water trap device 52 through a conduit 53. The watertrap device 52 ensures that water cannot enter the engine through its exhaust system, as is well known in this art. An exhaust pipe (not shown) extends rearwardly from the water trap device 52 and discharges the exhaust gases to the atmosphere. This exhaust pipe may terminate within the tunnel 44.

A fuel tank 54 is positioned in the engine compartment 37 forwardly of the watercraft device 52. The fuel tank 54, water trap device 52 and engine 38 are disposed substantially on a longitudinal centerline of the watercraft 11 for balancing purposes.

The rearward part of the deck portion 13, and specifically the raised portion 22, is formed with an access opening that is closed by a removable hatch cover 55. The hatch cover 55 may offer either access to a storage compartment, as will be described by reference to the embodiment of FIGS. 5 and 6, or directly to the engine compartment 37, for filling of the fuel tank 54 through its fill neck 56. Alternatively, the fuel tank 54 may have a fill opening that is formed in one side of the front part of the deck portion 13.

A ventilating compartment 57 is formed forwardly of the hatch cover 55 on the underside of the forward deck portion 13. A louvered or grilled air inlet opening 58 is formed in the deck portion 13 forwardly of the hatch 58 to communicate with the rear portion of the ventilating compartment 57. A breather tube 59 extends vertically upwardly from the engine compartment 37 into the ventilating compartment 57 and above its lower wall 61. The vent tube 59 because of this location will not draw water in, even if water does enter the ventilating compartment 57 through the vent opening 58. This is because of its upward placement. In addition, the configuration and spacing of the breather tube 59 forwardly of the vent opening 58 provides a circuitous path through which the air and water must pass and which will cause the water to separate from the air.

Finally, a battery 62 may be provided in the area beneath the seat back 17 and which can be accessible through an access door 63 formed in the rear of the seat 15 forward and above the rear deck 25.

Figure 5:
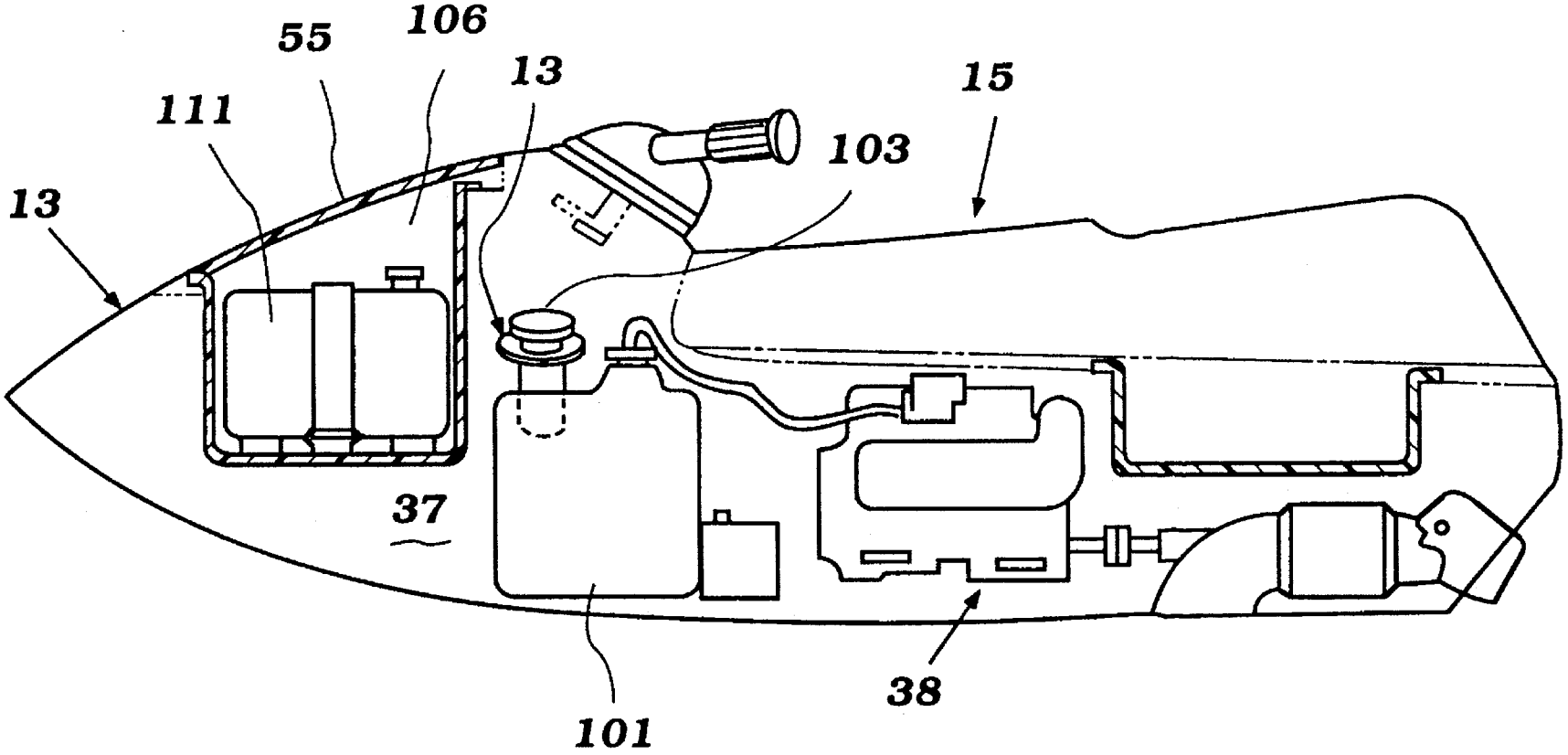
FIG. 5 is a cross-sectional view, in part similar to FIG. 4, and shows another embodiment of the invention.
Figure 6:
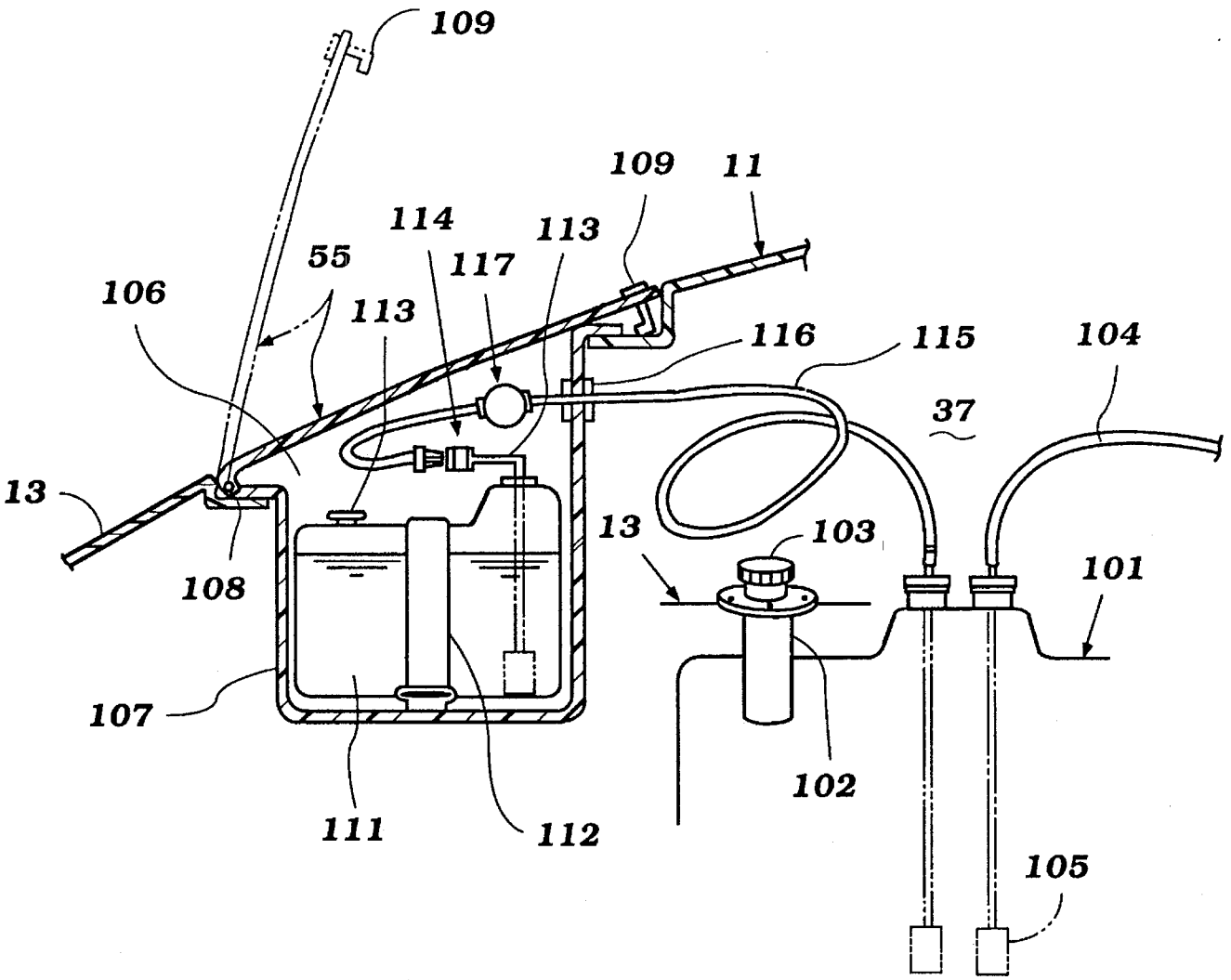
FIG. 6 is an enlarged view of the portion of FIG. 5 showing the fuel system with the auxiliary fuel tank access door being shown closed in solid lines and open in phantom lines.

As has been noted, the area under the hatch cover 55 may function as a storage compartment, and such an embodiment is shown in FIGS. 5 and 6. Except for this difference and the size and placement of the fuel tank for the engine, the construction of this watercraft may be considered to be the same as that previously described and, therefore, only those components of the watercraft which are necessary to illustrate this embodiment are illustrated, and where components are the same or substantially the same as those previously described, the same reference numerals have been utilized to identify them.

In this embodiment, a main fuel tank 101 is provided in the engine compartment 37, and it has a fill neck 102 that extends through the deck 13 and to which a fill cap 103 is detachably connected. A conduit 104 extends from a strainer 105 in the lower portion of the fuel tank 101 and supplies fuel to the engine 38 in a well known manner. Because the watercraft 11 is relatively small, and it is desired to maintain a low weight for normal operation, the capacity of the fuel tank 101 may be relatively small. However, for long distance cruising, and in accordance with an embodiment of the invention, a storage compartment 106 is formed beneath the hatch cover 55 by an inner wall 107.

FIG. 6 shows how the hatch cover 55, both in this and the previously described embodiment, may be opened and closed. A pair of pivot pins 106 are connected to the forward portion of the hatch 55 and journaled in the deck portion 13 in any known manner so as to permit pivotal movement between the closed position, as shown in solid lines in this figure, and an open position, as shown in phantom lines.

A latch mechanism 109 is provided at the rear end of the hatch cover 55 and cooperates with a keeper on the deck portion 13 for retaining the hatch cover 55 in the closed, solid line position.

Various devices or accessories may be carried in the storage compartment 107, and this includes an auxiliary fuel tank 111. The auxiliary fuel tank 111 is held in place by a strap or belt 112 and has its own fill neck 113 that is easily accessible when the hatch cover 55 is open.

The auxiliary fuel tank 111 is provided with a supply line 113 that has a quick disconnect coupling 114 that may be connected to a fuel line 115 that is affixed permanently to the watercraft 111 and which passes through a sealing grommet 116 from the engine compartment 37 to the storage compartment 106. A manually operated priming pump 117 is provided between the quick disconnect 114 and the grommet 116 so that fuel may be pumped from the auxiliary tank 111 to the main tank 101 when its fuel supply falls.

It should be readily apparent from the foregoing description that the described embodiments of the invention provide a very compact small watercraft, and yet one in which a passenger may be accommodated in a standing position behind the straddle-type operator's seat. In addition, the handle assembly and boarding ladder permit ease of boarding of the watercraft from the body of water in which it operates. Furthermore, the ventilating system provides compact yet effective ventilation and the provision of the auxiliary fuel tank and storage compartment therefor permits added fuel capacity for long range cruising. Of course, the foregoing description, including the specific configuration for the watercraft, are only exemplary of a preferred embodiment of the invention, and various changes and modifications may be made without departing from the spirit and scope of the invention, as defined by the appended claims.

We claim:

1. A small watercraft comprised of a hull, a passengers' area formed to the rear of said hull, a straddle-type seat formed in said passengers' area and adapted to accommodate at least one rider seated thereon in straddle fashion, a seat back formed at the rear of said straddle-type seat on which a rider may place his back, and means for forming a handle at the top of said seat back.

2. The small watercraft of claim 1, wherein the passengers' area includes a deck formed to the rear of the straddle-type seat on which the rider may stand.

3. The small watercraft of claim 1, wherein the passengers area is defined by a pair of foot areas disposed on opposite sides of the seat and bounded at their outer periphery by raised gunnels, said foot areas being adapted to accommodate the feet of the seated rider.

4. The small watercraft of claim 3, wherein the passengers' area includes a deck formed to the rear of the straddle-type seat on which the rider may stand.

5. The small watercraft of claim 4, wherein the rear deck merges into the foot areas.

6. The small watercraft of claim 1, wherein the rear of the passengers' area opens through the transom of the hull for boarding of the watercraft from a body of water in which the watercraft operates.

7. The small watercraft of claim 6, further including a boarding ladder supported for movement relative to the hull from a boarding position depending into the body of water in which the watercraft is operating and a storage position recessed into the hull.

8. The small watercraft of claim 7, wherein the passengers' area includes a deck formed to the rear of the straddle-type seat on which the rider may stand.

9. The small watercraft of claim 8, wherein the deck is formed with a recess into which the boarding ladder nests when in its storage position.

10. The small watercraft of claim 9, wherein the passengers area is defined by a pair of foot areas disposed on opposite sides of the seat and bounded at their outer periphery by raised gunnels, said foot areas being adapted to accommodate the feet of the seated rider.

11. The small watercraft of claim 10, wherein the rear deck merges into the foot areas.

12. The small watercraft of claim 1, wherein the handle comprises a horizontally extending portion extending transversely across the seat back and a pair of side portions connected to the seat back.

13. The small watercraft of claim 12, wherein the hull forms an engine compartment extending at least in part beneath the passengers' area and wherein there is provided a forward deck forward of the passengers' area, a ventilator compartment formed beneath a forward part of said forward deck, an air inlet formed in said forward deck for communicating atmospheric air to said ventilating compartment, and a breather tube extending from an upper area of said ventilating compartment spaced from said air inlet into said engine compartment for delivering ventilating air thereto.

14. The small watercraft of claim 13, wherein the air inlet comprises a grilled opening at the rear portion of the ventilating compartment.

15. The small watercraft of claim 14, wherein the breather tube is disposed at the forward portion of the ventilating compartment.

16. The small watercraft of claim 13, further including a storage compartment formed in the forward deck rearwardly of the air inlet.

17. The small watercraft of claim 16, further including a main fuel tank positioned in the engine compartment and an auxiliary fuel tank positioned in the storage compartment and means for transferring fuel from the auxiliary tank to the main tank.

18. A small watercraft comprising of a hull defining an engine compartment, a forward deck and a passengers' area to the rear of said forward deck, a ventilating compartment formed beneath a forward portion of said forward deck, an air inlet formed in said forward deck for communicating atmospheric air to said ventilating compartment, a storage compartment formed in the forward deck rearwardly of said air inlet, and a breather tube extending from an upper area of said ventilating compartment spaced from said air inlet into said engine compartment for delivering ventilating air thereto.

19. The small watercraft of claim 18, wherein the air inlet comprises a grilled opening at the rear portion of the ventilating compartment.

20. The small watercraft of claim 19, wherein the breather tube is disposed at the forward portion of the ventilating compartment.

21. The small watercraft of claim 20, further including a main fuel tank positioned in the engine compartment and an auxiliary fuel tank positioned in the storage compartment and means for transferring fuel from the auxiliary tank to the main tank.

22. A small watercraft comprising of a hull defining an engine compartment, a forward deck and a passengers' area to the rear of said forward deck, an engine positioned in said engine compartment and driving a propulsion device for propelling said watercraft, a main fuel tank in said engine compartment for supplying fuel to said engine, said forward deck defining a storage compartment therebeneath, an auxiliary fuel tank contained within said storage compartment, and means for delivering fuel from said auxiliary tank to said main tank.

* * * * *